United States Patent [19]

Ferziger et al.

[11] Patent Number: 4,677,016

[45] Date of Patent: Jun. 30, 1987

[54] FOAM COATED FABRICS

[75] Inventors: Daniel Ferziger, 4515 Greystone Ave., New York, N.Y. 10471; Jerry Lippman, North Bergen, N.J.

[73] Assignee: Daniel Ferziger, Riverdale, N.Y.

[21] Appl. No.: 767,743

[22] Filed: Aug. 21, 1985

Related U.S. Application Data

[63] Continuation of Ser. No. 495,419, May 17, 1983, abandoned.

[51] Int. Cl.[4] ..... B32B 17/04

[52] U.S. Cl. ..... 428/212; 427/389.9; 427/407.3; 428/251; 428/268; 428/311.5; 428/314.2; 428/920; 428/921

[58] Field of Search ..... 428/251, 268, 311.5, 428/314.2, 920, 921, 212; 427/389.9, 407.3

[56] References Cited

U.S. PATENT DOCUMENTS 3,490,485 1/1970 Marzocchi et al. ..... 161/93
3,862,291 1/1975 Brandon, Jr. et al. ..... 264/321
4,265,962 5/1981 May ..... 428/287
4,526,830 7/1985 Ferziger et al. ..... 428/268

FOREIGN PATENT DOCUMENTS 476279 8/1951 Canada .
867746 5/1961 United Kingdom .

*Primary Examiner*—Marion C. McCamish

[57] ABSTRACT

This application discloses a flame retardant, drapable, and substantially light impermeable fabric suitable for use as a curtain, window shade or the like comprising a tightly woven fiberglass fabric substrate which is coated on at least one surface thereof with one or more layers of a flame retardant foam coating composition. At least one of the foam coating layers is opaque and is comprised of a cured layer of flame retardant polymeric latex foam which renders the fabric substantially impermeable to light and is applied to the surface of the fiberglass substrate in an amount sufficient to make the fabric non-abrasive, abrasion resistant, and the coated fabric sewable and drapable.

17 Claims, No Drawings

FOAM COATED FABRICS

This is a continuation of application Ser. No. 495,419 filed May 17, 1983, now abandoned.

FIELD OF THE INVENTION

This invention relates to foam coated fiberglass fabrics suitable for use as blackout curtains.

BACKGROUND OF THE INVENTION

The term "blackout curtain" refers to curtain products which are substantially impermeable to light. Thus, when a blackout curtain is hung as a window dressing, it will block substantially all external light from entering the room through the window to which the blackout curtain is applied. Blackout curtains are suitable for domestic use, and are particularly well suited for institutional use in hospitals, prisons, etc., as well as for use in commercial establishments such as hotels, motels, movie theaters, etc., where the option of excluding light from a room when desired is important. For domestic use, as well as for use in the commercial and institutional establishments mentioned, it is also desirable from a safety standpoint that the fabric from which the blackout curtain is manufactured be flame retardant.

Fiberglass fabrics are inherently flame retardant. However, prior art uses of fiberglass in the manufacture of blackout curtains have included the application of a thick flammable foam layer of a polyurethane polymer to a woven fiberglass substrate. As a result, any advantage which might have been obtained through the use of the flame retardant fiberglass substrate has been largely negated by the flammable polyurethane surface layer applied to the fiberglass substrate.

It is an object of this invention to provide a foam-coated fiberglass fabric suitable for use as a blackout curtain which is substantially light impermeable and flame retardant, while at the same time possessing the drapability and suppleness characteristic of textiles used to manufacture curtain products.

BRIEF DESCRIPTION OF THE INVENTION

In accordance with the foregoing objectives, the present invention provides a flame retardant, drapable and substantially light impermeable fabric suitable for use as a curtain, window shade or the like comprising a tightly woven fiberglass fabric substrate which is coated on at least one surface thereof with one or more layers of a flame retardant foam coating composition, wherein at least one of the foam coating layers is opaque and is comprised of a cured layer of flame retardant polymeric latex foam; wherein the foam coating renders the fabric substantially impermeable to light and is applied to the surface of the fiberglass substrate in an amount sufficient to make the fabric nonabrasive, abrasion resistant, and the coated fabric sewable and drapable.

In one embodiment of the invention the foam coating is comprised of at least three coating layers, wherein the innermost coating layer is white in color, the intermediate coating layer is grey or black in color and the outermost coating layer is white; wherein in each of the coating layers the pigment is dispersed in a coating composition comprised on a dry-weight basis of about 100 parts of a foamable polymer latex, and based on the weight of the polymer latex, about 2 to about 10 parts plasticizer, about 1 to about 10 parts flame retardant, about 10 to about 50 parts pigment, surfactant, about 25 to about 75 parts filler, and dispersant for the pigment.

DETAILED DESCRIPTION OF THE INVENTION

One embodiment of the invention comprises a flame retardant, drapable and substantially light impermeable fabric suitable for use as a curtain, window shade or the like comprising a tightly woven fiberglass fabric substrate which is coated on at least one surface thereof with one or more layers of a flame retardant foam coating composition, wherein at least one of the foam coating layers is opaque and is comprised of a cured layer of flame retardant polymeric latex foam; wherein the foam coating renders the fabric substantially impermeable to light and is applied to the surface of the fiberglass substrate in an amount sufficient to make the fabric nonabrasive, abrasion resistant, and the coated fabric sewable and drapable.

The fabrics of the preferred embodiment of this invention are comprised of a tightly woven fiberglass fabric substrate, which is coated on one surface with a flame retardant polymeric face coat, and on the opposite surface of the fabric, with a flame retardant polymeric foam coating composition which imparts the blackout properties to the fabric.

The fiberglass fabrics employed in this embodiment are the tightly woven fiberglass fabrics. In general, suitable tightly woven fabrics may be comprised of C, D, E or D/E glass fibers, and may have a fabric thickness of about 1.3 to about 46 mils, preferably about 10 mils; a fabric weight of about 1.5 to about 25 ounces per square yard and, preferably, about 6.9 to about 12.5 ounces per square yard.

The Denier of the yarn from which the fabric is woven may be about 100–1200; for example, particularly suitable yarn Deniers include Deniers of 100, 300, 600, 900 or 1200. The individual fiber strands may be comprised of about 408–1632 filaments per strand, e.g., 816 filaments per strand for a C-yarn, 300 Denier, 1632 filaments per strand for a C-yarn 600 Denier; 408 filaments per strand for a D/E yarn of 300 Denier; 1632 filaments per strand for a D/E yarn of 1200 Denier. Tensile strengths in the warp may range from about 45 to about 1658 lbs. per square inch, and in the fill from about 32 to about 1371 lbs. per square inch.

The tightly woven fiberglass fabrics employed herein may be woven in any conventional pattern including Jacquard, Darby, 12-Harness Satin, or Taffeta (e.g., 1×1, 2×2, 2×1, 3×1 or 4×1) weaves.

The face coat renders the normally abrasive surface of the fiberglass fabric to which it is applied non-abrasive and abrasion resistant. Moreover, when the fabric is employed as a blackout curtain, the face coat will preferably be applied to the surface of the curtain intended to face into the room. As will be explained in greater detail below, the face coat comprises a very thin and, preferably, transparent polymeric layer on the fabric substrate. The face coat does not significantly contribute to the light impermeable properties of the fabric product. However, for decorative purposes the surface of the fabric substrate to which the face coat is applied may have a decorative design printed or painted thereon which will be visible through the transparent face coat. The face coat may also be pigmented in order to impart a desired coloration to the surface of the fabric substrate.

The surface of the fabric substrate, opposite to the surface to which the face coat is applied, is coated with a flame retardant foam coating composition which renders the fabric light impermeable. The foam coating is comprised of one or more layers of coating composition. Preferably, the outermost foam layer includes a white pigment or another aesthetically appealing color, while at least one of the intermediate layers of foam includes a black or grey pigment in order to enhance the light blocking properties of the fabric.

In the detailed discussion which follows, the chemical composition and mode of application of the face coat will be described first, followed by a detailed description of the chemical composition and mode of application of the light blocking foam coating employed on the fabric of this invention.

The face coating which is applied to the fiberglass fabric substrate comprises a polymeric carrier, which contains one or more component ingredients which contribute to the flame retardance of the coating, such as antimony pentaoxide and/or antimony trioxide. Of course, if an inherently flame retardant polymeric coating is employed, a chemical flame retardant additive need not be included in the coating composition.

The face coating formulation may also contain an effective amount of plasticizer, and a filler. The filler is preferably selected so that it also contributes to the flame retardant properties of the coating, e.g., aluminum trihydrate.

Suitable polymeric carriers for use in the face coating composition include halogen containing polymers such as polyvinyl chloride, polyvinyl chloride acetate copolymer, or acrylic polymer latexes, such as acrylic vinyl chloride latex, or ethylene vinylidine chloride polymers. Suitable ethylene vinyl chloride polymeric carriers are commercially available from the Air Products Corp., under the trade name Air Flex 45-14. Alternatively, the polymeric carrier may be polychloroprene (i.e., neoprene).

The preferred polymeric carrier is acrylic vinyl chloride latex. Polymers of this type are commercially available from the B. F. Goodrich Co. of Akron, Ohio under the chemical product designation 460X46.

Any conventional plasticizer which is compatible with the other ingredients of the face coating formulation may be employed. For example, suitable plasticizers include paratricresyl phosphate, octyldiphenyl phosphate, as well as the chlorinated or brominated paraffin type plasticizers which, in addition to improving the "hand" of the coating, contribute to the flame retardant properties of the formulation. Preferred halogenated paraffin plasticizers are the chlorinated paraffins having about a 50% chlorine content.

Flame retardants suitable for use in the face coating composition include antimony trioxide and/or antimony pentaoxide, or other metal oxides such as molybdenum oxide which, in addition to imparting flame retardant properties to the coating formulation, also function to suppress smoke formation.

The face coating may also include as a filler, an ingredient such as aluminum trihydrate which contributes to the flame retardance of the coating. When exposed to heat, aluminum trihydrate releases moisture and, hence, contributes to the overall flame retardance of the coating.

Antibacterial and/or antifungal properties may also be imparted to the face coat by including a bacteriostatic and/or fungistatic agent in the coating formulation. Any conventional bacteriocide and/or fungicide which is compatible with the polymeric carrier, and the other components of the formulation, may be employed, e.g., N-trichloromethylthio-4-cyclohexene-1,2-dicarboximide or the bis(tri-n-alkyltin)sulfosalicylates. The bacteriocidal and fungicidal properties of N-trichloromethylthio-4-cyclohexene-1,2-dicarboximide may also function to prevent the stiffening of the coating due to the plasticizer depletion caused by the activity of bacteria and fungi. This compound is commercially available from R. T. Vanderbuilt, Inc., 20 Winfield Street, Norwalk, Conn., and is sold under the trade name Vancide 89.

In order the function effectively as a fungicide and in particular to prevent unsightly mildew and bacterial growth, the fungicidal and/or bacteriocidal component must migrate to the surface of the coating layer. The rate of migration of the fungicidal and/or bacteriocidal component is determined by the compatibility of the component in the coating formulation. In accordance with the face coating formulation of this invention from about 0.5 to 2 parts, and preferably about 1 part, of a fungicide and bacteriocide (based on 100 parts of the polymeric carrier) such as N-trichloromethylthio-4-cyclohexene-1,2-dicarboximide is employed. At this concentration level the fungicide and bacteriocide are compatible with the other components of the formulation, and a concentration of the ingredient on the surface of the coating which is effective against fungi and bacteria is provided.

Preferably, the face coating formulation comprises on a dry weight basis and based on 100 parts of the polymeric carrier, from about 25 to 75 parts of the filler (e.g., aluminum trihydrate), from about 5 to 25 parts of the plasticizer, and from about 3 to 10 parts of antimony trioxide or antimony pentaoxide. Preferably, the polymeric carrier is an acrylic vinyl chloride latex, the filler is aluminum trihydrate, and the plasticizer is a chlorinated paraffin having about a 50% chlorine content. For example, the coating formulation may comprise on a dry-weight basis about 140 parts acrylic vinyl chlorine latex, about 56 parts aluminum trihydrate, about 6 parts antimony pentaoxide, and about 30 parts of a chlorinated paraffin (50% chlorine).

The face coating formulation is prepared by first mixing together the polymeric carrier, antimony pentaoxide and aluminum trihydrate in the form of about 50% dispersions of each of these components in water. Although aqueous solvent systems are preferred since they do not present the environmental hazards associated with more volatile solvent systems, other compatible solvent systems may be employed. Moreover, commercially available plastisols of, for example, polyvinyl chloride or vinyl chloride acetate copolymers may be employed with effective amounts of the flame retardant components described above added to the plastisol.

A fine grade of aluminum trihydrate is employed in the face coat, with the average particle size of this component preferably being less than about 10 microns. Before being added to the other components of the face coating composition, the aluminum trihydrate particles are dispersed in water with the aid of suitable dispersing agent such as trisodium or tetrasodium phosphate. The plasticizer component is added to the dispersion of the polymeric carrier, flame retardant and filler.

Prior to applying the face coat onto the fabric base, the viscosity of the formulation is adjusted through the addition of a suitable thickener. The viscosity to which the formulation is adjusted will be determined by the particular coating method employed. Suitable thickeners include methylcellulose, high molecular weight acrylic acids or, preferably, a nonionic thickener such as Carbopol, which is commercially available from B. F. Goodrich Chemical Corp.

After the viscosity of the formulation has been adjusted, the pH of the formulation is adjusted to below about 7.0, and preferably within the range of from about 5.5 to 6.5 with acid or base as required. Preferably the acid employed for pH adjustment is acetic acid and the preferred base is ammonia.

Any conventional coating process may be employed to apply the face coating formulation to the fabric base. For example, a floating knife process, a knife over-roll process, or a reverse-roll coating process may be employed. For use in a floating knife coating process, the viscosity of the formulation should be adjusted through the addition of a thickener to from about 4,000 to 16,000 centipoises, and preferably about 16,000 centipoises. When a knife over-roll coating process is employed, the viscosity of the formulation is preferably adjusted to from about 50,000 to 60,000 centipoises. For use in a reverse-roll coating process the viscosity of the formulation is preferably adjusted to from about 4,000 to 5,000 centipoises.

A preferred coating process for use in applying the face coat to the fiberglass fabric base is the floating knife process, wherein the viscosity of the coating formulation is adjusted to about 16,000 centipoises through the addition of about 1–5 parts of the thickener (on a dry weight basis) to the coating formulation.

The face coating composition may be applied in one or more coating passes, and preferably comprises a very thin, visually imperceptible coating layer on the fabric base, in the amount of about 0.125 to about 1.0 ounces per square yard of the fabric base and most preferably about 0.5 ounces per square yard of the fabric base.

The face coat adheres well to conventionally manufactured fiberglass fabrics, and does not require auxiliary adhesion promoters. However, adhesion promoters may be included in the coating formulation, and their use may be desired where caronized fiberglass fabrics are utilized. Useful adhesion promoters include N-(2-aminoethyl-3-aminopropyl)-trimethoxy silane. Adhesion promoters of this type are commercially available from the Union Carbide Corp. under the product designation A1120.

When the polymeric component of the face coat is a latex type carrier, such as an acrylic vinyl chloride latex carrier, the surface texture of the cured fabric coating may be finished by applying a top coat layer to the cured acrylic vinyl chloride latex coating. The top coat is adapted to provide a smooth, and abrasion resistant surface on the fabric product. For example, a top coat of a harder vinyl chloride acrylic compound than that employed in the acrylic vinyl chloride base coat layer, may be employed as the top coat.

Vinyl chloride acrylic polymers well suited for use as a top coat are commercially available from B. F. Goodrich Co., under product designation 460X45. If desired, the coating formulation employed as the top coat may also include a plasticizer. The total amount of coating composition employed as the face coat, including any top coat applied to the fabric, should not exceed about 0.5–1.0 ounces per square yard.

A fiberglass fabric treated with only the face coating composition would transmit light. In accordance with this invention, one or more coating layers of a flame retardant foam coating composition are applied to the surface of the fiberglass fabric substrate opposite to the surface to which the face coating is applied in order to render the fiberglass fabric light impermeable.

The foam coating may be applied to the fabric by successively coating the fabric with discrete layers of the foam coating composition. The coating layers are then individually dried on the surface of the fabric to produce a strongly adherent composite foam layer, and the adherent composite foam layers may then be cured in one heat curing step.

A preferred foam coating composition for use in this invention comprises on a dry-weight basis, and based on 100 parts of a foamable polymer, from about 25 to 75 parts of the filler (e.g., aluminum trihydrate and/or silicon dioxide), from about 2 to 10 parts of the plasticizer, from about 1 to 10 parts of a flame retardant such as antimony trioxide, antimony pentaoxide, or molybdenum oxide, from about 5 to 10 parts of surfactant, from about 10 to 50 parts of pigment, and thickner. A dispersant for the pigment and a pH-adjusting material are present in small quantities, usually no more than about 2 parts by weight of each. The foregoing ingredients are dispersed in water, foamed by the introduction of air (or another inert gas), and coated onto the fiberglass substrate by a conventional coating process.

The foamable polymer may be any one of the polymeric materials mentioned above with respect to the face coating composition. However, a preferred foamable polymer is an acrylic vinyl chloride latex emulsion such as B. F. Goodrich Co. product 460X46.

As thickeners, the foamable compositions of this invention may include alkaline soluble polymeric emulsions. Polymeric thickeners are preferably of the polyacrylic acid or polyalkyl acrylate type which contain a polymer solids content of from about 10 to 40 percent by weight. Representative of such thickeners are ASE 60, ASE 75 or ASE 95 which are commercially available from the Rohm and Haas Co.

The foamable compositions of this invention also employ foam-forming amounts of surfactants which influence the final cellular structure of the foam. Although effective surfactants may be chosen from a wide variety of nonionic, or anionic surfactants, the anionic surfactants are generally preferred. Such surfactants include sodium lauryl sulfate, sodium lauryl ether sulfate, triethanol amine oleate, potassium oleate, ammonium stearate and the like, as well as mixtures thereof.

The pigment component of the foam may be employed in the form of an aqueous dispersion which incorporates the desired pigments as well as a dispersant for the pigment. Suitable pigments include titanium dioxide, carbon black, iron oxides, aluminum and the like. Suitable pigment dispersants include potassium hexametaphosphate, sodium phosphate or one of the other pigment dispersants conventionally employed in the art.

In a preferred embodiment of this invention, the first foam layer to be applied to the fabric base will incorporate a white pigment (e.g., titanium dioxide), the second foam layer will incorporate a black or grey pigment (e.g., carbon black), and preferably a third, or outermost foam layer incorporates a white or light-colored pigment. It has been found that this mode of foam layer application produces an effective resistance to light penetration in a finished fabric, while imparting a light-colored outer surface to the fabric which may be further colored or tinted by the use of an appropriate dye, printing process, etc.

The aqueous pigment dispersion may also incorporate a dispersed filler. Such fillers may be chosen from any of those conventionally used in foam preparation, such as pulverized silaceous powders, calcium carbonate, talc, aluminum trihydrate or mixtures thereof.

A plasticizer which functions to soften the polymer and enhance the flame retardancy of the foam may also be included in the foam coating composition. Any conventional plasticizer which is compatible with the other components of the foamable composition may be employed. Suitable plasticizers have been described above with reference to the face coat.

The foamable composition may be prepared, for example, by first forming an aqueous dispersion of the filler, pigment and pigment dispersant in water. Next, the surfactant or mixture of surfactants is added to the dispersion which is slowly stirred so as to prevent the introduction of foam.

Next, the foamable polymer (i.e., acrylic vinyl chloride latex) is filtered into the stirred mixture, followed by the addition of an aqueous dispersion of flame retardant, plasticizer and thickener. When an acrylic vinyl chloride latex is employed, the pH is adjusted to the range of about 8–10, and the initial viscosity of the foamable composition is measured. Additional thickener is added and, if necessary, additional water, in order to bring the final viscosity into desired range.

More specifically, the pre-foamed composition is thickened to the extent that the foam which is subsequently formed from the composition has a viscosity and density suitable for application to the fiberglass substrate by one of the conventional coating processes. Thus, when a knife-over-roll process is employed, the viscosity of the thickened formulation is adjusted such that after incorporation of air during the foaming step, the viscosity of the coating composition is about 5,000–20,000 cps. In general, however, it is desirable that the density of foamed composition be about 20% to about 50%, i.e., about 33% of the pre-foamed composition. The composition is foamed by whipping in air to the desired air-to-composition ratio (generally within the range of 2–6 parts of air to one part of composition). The step of foaming the composition may be performed in any conventional foamer, such as an Oakes mixer.

After application to the fabric base, the wet foam is dried, and preferably crushed between calender rolls, in order to compress air bubbles in the foam, and to provide a flat and uniform foam layer on the fabric. The final foam coating is preferably comprised of a series of individually dried foam layers, which are all cured in one step by the application of heat. The foam coating preferably comprises about 1 to about 3 ounces per square yard of fabric.

The thickness of any individual layer of wet foam applied to the fabric may be about 15–40 mil, and it has been found desirable to employ foamed compositions of decreasing densities when multicoating the fabric base, e.g., by using a composition which has been whipped to three times its initial unfoamed volume, as a first coating layer, followed by two more foam layers which have been whipped to four and five times their initial unfoamed volumes. At least one foam layer, and preferably the intermediate layer or the first foam coating layer, includes a pigment which renders the foam opaque, such as carbon black. In addition, it is preferred that the outermost coating layer include a pigment which imparts a decoratively appealing color to the coating.

Optional finishing steps may include crushing the cured foam by compression to reduce the cell size and/or applying an outermost layer of flame retardant cotton flock. In addition, foam coating may be applied to a base coating layer comprised of the face coating composition, or another preliminary coating on the fiberglass substrate. Alternatively, both surfaces of the fiberglass fabric may be coated with the foam coating composition, and the face coating may be eliminated.

The foam coated fabrics of this invention are highly flame retardant, and even when exposed to an open flame release extremely little or no smoke. These properties, in combination with light-blocking properties, render the the fabrics of this invention ideally suited for use as curtains in hotels, hospitals or the like.

Furthermore, the face coat and the light impermeable foam coating described herein impart a number of other desirable properties to the finished fabric product.

In particular, whereas untreated fiberglass fabrics tend to abrade during use, and possess an abrasive surface texture, the surfaces of the fabric of this invention are smooth and non-abrasive. Moreover, the coating compositions applied to the fabric base bind and coat the glass threads of the fabric base which effectively eliminates the danger of fraying or breaking-off of bits of glass fibers, which in the past has rendered untreated fiberglass unsuitable for use in articles where skin contact would be involved.

Further, the fiberglass fabrics of this invention may be fabricated into articles by conventional sewing processes, without the danger of seam separation which occurs during attempts to sew untreated fiberglass fabrics.

In addition, in accordance with this invention the tightly woven fiberglass base is thinly coated with plasticized coating compositions. The resultant fiberglass fabric is drapable and possesses the suppleness characteristics of a textile. Thus, the fabrics of this invention are suitable for use in the manufacture of window curtains. It should be noted that the term "curtain" as employed herein is intended to include window curtains as well as shades, room dividers, or cubicle curtains suitable for use in the home, hospitals, hotels, movie theaters, film processing laboratories, etc.

The invention will be described further with reference to the following detailed examples.

EXAMPLE 1

A face coating formulation is prepared containing on a dry-weight basis:

| | Parts |
|---|---|
| Acrylic Vinyl Choroide Latex (460X46 — B. F. Goodrich Co.) | 140 |
| Aluminum Trihydrate | 56 |
| Antimony pentaoxide | 10 |
| Chlorinated Paraffin Plasticizer (50% Chlorine) | 30 |

The formulation is prepared by mixing together a 50% aqueous dispersion of the acrylic vinyl chloride latex and a 50% aqueous dispersion of the antimony pentaoxide. Prior to adding the aluminum trihydrate, this compound is ground in a mill until the average particle size is about 5 microns. A 50% aqueous dispersion of the milled aluminum trihydrate is prepared by dispersing the compound in water in the presence of about 1% by weight of trisodium phosphate. The aqueous dispersion of the aluminum trihydrate is then added to the aqueous dispersion of the polymer and the antimony pentaoxide. Thirty parts of a chlorinated paraffin (60% chlorine content) plasticizer are then added to the aqueous dispersion of the other ingredients, and the formulation is mixed in a high speed mixer until uniform.

The viscosity of the formulation is adjusted to about 16,000 centipoises through the addition of about 1.6 parts by weight of Carbopol. The pH of the formulation is then adjusted to preferaly within the range of from about 8 to 10 through the addition of 28% ammonium hydroxide. The coating formulation is applied to a tightly woven fiberglass fabric base by a floating-knife coating process.

The fabric is woven from a C-fiber which is one turn out-of-twist and has a Denier of about 75. The coating layer is applied to one side of the fabric in one of several passes in the amount of about 0.125 to about 1.0 ounces per square yard of fabric, and the coating is dried and then cured by passing it through an oven at a temperature of about 325° F.

A top coating layer is provided by applying a thin surface layer to the fabric comprised of an aqueous dispersion of a polyvinyl chloride acrylic polymer (B. F. Goodrich Co. 460X45). The top coat may include a plasticizer and/or bacteriocidal, fungicidal or other additions. The viscosity of the top coat is adjusted and applied to the fabric by a floating-knife process as described above. Totally the face coat does not exceed about 1 ounce per surface yard of the fabric.

EXAMPLE 2

A foamable composition, adapted to be foamed into a white foam and applied in layers to the untreated surface of the fabric of Example 1, is prepared containing on a dry-weight basis (except as noted):

| | Parts |
|---|---|
| Antimony Pentaoxide (50% dispersion in water) | 10 |
| Silicon Dioxide | 40 |
| Aluminate Trihydrate | 40 |
| Titanium Dioxide Pigment | 25 |
| Ammonium Stearate | 33 |
| Sodium Lauryl Sulfate | 2 |
| Acrylic Vinyl Chloride Latex (50% emulsion in water) | 200 |
| Chlorinated Paraffin Plasticizer (Chlorowax 500 C) | 10 |
| Dispersant | 1.5 |
| ASE-60 Thickener (50% emulsion in water) | 8 |
| Ammonia (28% aqueous ammonia hydroxide) | 2 |

The foamable composition is prepared by forming a premix of the dispersant, aluminum trihydrate, silicon dioxide and titanium dioxide in 80 parts of water, with slow stirring to blend the ingredients so that no foam is introduced. The ammonium stearate and sodium lauryl sulfate are then combined and added, followed by adding, with filtration, the latex emulsion with continued stirring.

The antimony pentaoxide dispersion, plasticizer and 3 parts of the ASE-60 are then added. The mixture was made alkaline by the addition of the ammonia. The viscosity of the composition is then adjusted to 3,200 cps by the addition of 5 parts of ASE-60 (Brookfield viscometer, 20 rpm, No. 4 spindle). The composition was whipped to about three times its original volume with air to form an opaque white foam. The foam was applied onto the fiberglass fabric base by the knife overroll method to a thickness of about 20 mil. The foam coating was oven cured at a surface temperature of no greater than 212° F.

An opaque black or grey foamable composition was prepared by adding carbon black water-dispersion to the titanium dioxide in the above formula. The composition was foamed to four times its original volume by whipping in air. The dark foam was spread onto the white foam later to a thickness of about 30 mil, (wet) and cured as described above.

Next, a second layer of the white foamable composition described was whipped to five times its original volume with air and spread over the black foam layer to a thickness of 20–30 mil, and then cured.

The finished foam coated, polymer-treated fabric is suitable for use as a blackout curtain or shade as it is impermeable to light as determined by visual observation.

While the specific embodiments of the invention have been described with particularity herein, it should be understood that this invention is intended to cover all changes and modifications of the embodiments of the invention chosen herein for purposes of illustration which do not constitute departures from the spirit and scope of the present invention.

What is claimed is:

1. A flame retardant, drapable and substantially light impermeable fabric suitable for use as a curtain, window shade or the like comprising a tightly woven fiberglass fabric substrate which is coated on at least one surface thereof with one or more layers of a flame retardant foam coating composition, wherein at least one of the foam coating layers is opaque and is comprised of a cured layer of flame retardant polymeric latex foam; wherein the foam coating renders the fabric substantially impermeable to light and is applied to the surface of the fiberglass substrate in an amount sufficient to make the fabric non-abrasive, abrasion resistant, and the coated fabric sewable and drapable.

2. The fabric according to claim 1 wherein the foam coating composition is comprised on a dry-weight basis and based on about 100 parts of a foamable polymer latex, of about 2 to about 10 parts plasticizer, about 1 to about 10 parts of a flame retardant, about 10 to about 50 parts pigment, filler, and dispersant for the pigment and filler.

3. The fabric according to claim 1 wherein the coating is comprised of at least three coating layers, wherein the innermost coating layer is white in color, the intermediate coating layer is grey or black in color and the outermost coating layer is white; wherein in each of the coating layers the pigment is dispersed in a coating composition comprised on a dry-weight basis of about 100 parts of a foamable polymer latex, and based on the weight of the polymer latex, about 2 to about 10 parts plasticizer, about 1 to about 10 parts flame retardant, about 10 to about 50 parts pigment, surfactant, about 25 to about 75 parts filler, and dispersant for the pigment.

4. The fabric according to claim 3 wherein the fiberglass substrate is comprised of C, D, E or D/E glass fibers.

5. The fabric according to claim 3 wherein the polymer latex is an acrylic polymer latex.

6. The fabric according to claim 3 wherein the foam coating comprises up to about 3 ounces per square yard of the fiberglass fabric base.

7. The fabric according to claim 3 wherein the surface of the fabric opposite to the foam coated surface is coated with a face coat of a flame retardant and plasticized polymeric coating composition which is present in an amount sufficient to render the surface of said fiberglass fabric nonabrasive and abrasion resistant.

8. The fabric according to claim 8 wherein the face coat is comprised on a dry-weight basis and based on 100 parts of a foamable acrylic polymer, of about 25 to 75 parts filler, about 5 to about 25 parts plasticizer, and about 3 to about 10 parts antimony trioxide or antimony pentaoxide.

9. A curtain comprised of the fabric of claim 3.

10. A window shade comprised of the fabric of claim 3.

11. The fabric according to claim 1 wherein the surface of the fiberglass fabric opposite to the foam coated surface is coated with a face coat of a flame retardant and plasticized polymeric coating composition which is present in an amount sufficient to render the surface of said fiberglass fabric nonabrasive and abrasion resistant.

12. A curtain comprised of the fabric of claim 1.

13. A window shade comprised of the fabric of claim 1.

14. A flame retardant, drapable and substantially light impermeable fabric suitable for use as a curtain, window shade or the like comprising a tightly woven fiberglass fabric substrate which is coated on at least one surface thereof with one or more layers of a flame retardant foam coating composition, wherein at least one of the foam coating layers is opaque and is comprised of a cured layer of flame retardant polymeric latex foam; wherein the foam coating renders the fabric substantially impermeable to light and is applied to the surface of the fiberglass substrate in an amount sufficient to make the fabric non-abrasive, abrasion resistant, and the coated fabric sewable and drapable; and wherein the coating is comprised of at least three coating layers, wherein the innermost coating layer is white in color, the intermediate coating layer is grey or black in color and the outermost coating layer is white; wherein in each of the coating layers the pigment is dispersed in a coating composition comprised on a dry-weight basis of about 100 parts of a foamable polymer latex, and based on the weight of the polymer latex, about 2 to about 10 parts plasticizer, about 1 to about 10 parts flame retardant, about 10 to about 50 parts pigment, surfactant, about 25 to about 75 parts filler, and dispersant for the pigment.

15. A method for preparing a flame retardant, drapable and sewable fabric which does not transmit light comprising:

A. coating a tightly woven fiberglass fabric substrate with at least one coating layer of an opaque foam coating composition comprised on a dry-weight basis of about 100 parts of a foamable polymer, about 2 to about 10 parts plasticizer, about 1 to about 10 parts flame retardant, about 5 to about 10 parts surfactant, about 10 to about 50 parts pigment, and dispersant for the pigment and thickener, the components of said composition being foamed with air; and then B. curing said foam coating to provide an opaque foam coating on said fiberglass base.

16. The method according to claim 15 wherein said foam coating is comprised of at least three layers, wherein the pigment in the innermost coating layer renders said coating white and said innermost coating layer is cured prior to the application of the intermediate coating layer; the pigment in the intermediate coating layer renders said coating opaque and is cured prior to the application of the outermost coating layer; and the pigment in the outermost coating layer renders the coating white; and wherein the thickness of each foam layer prior to curing is about 15 to about 40 mils.

17. The method according to claim 16 wherein the volume of the composition which comprises the innermost foam coating is about three times the volume of said composition prior to being foamed; the volume of the composition comprising the intermediate coating layer is about four times the volume of said composition prior to being foamed; and the volume of the outermost coating layer is about five times the volume of the composition prior to being foamed.

* * * * *